US010002508B2

(12) United States Patent
Rogers

(10) Patent No.: US 10,002,508 B2
(45) Date of Patent: Jun. 19, 2018

(54) PNEUMATIC FIRE DETECTORS

(71) Applicant: Kidde Technologies, Inc., Wilson, NC (US)

(72) Inventor: Aaron S. Rogers, Surf City, NC (US)

(73) Assignee: Kidde Technologies, Inc., Wilson, NC (US)

( * ) Notice: Subject to any disclaimer, the term of this patent is extended or adjusted under 35 U.S.C. 154(b) by 0 days. days.

(21) Appl. No.: 15/040,322

(22) Filed: Feb. 10, 2016

(65) Prior Publication Data

US 2017/0228994 A1 Aug. 10, 2017

(51) Int. Cl.

| | |
|---|---|
| ***G08B 17/04*** | (2006.01) |
| ***G08B 17/02*** | (2006.01) |
| ***G08B 7/04*** | (2006.01) |
| ***G08B 13/20*** | (2006.01) |

(52) U.S. Cl.
CPC ..... *G08B 17/04* (2013.01)

(58) Field of Classification Search
CPC ... G08B 17/04; H01H 35/2671; H01H 35/346
USPC ..... 340/592, 591, 815.72, 544
See application file for complete search history.

(56) References Cited

U.S. PATENT DOCUMENTS 3,010,001 A * 11/1961 Swift ..... G08B 17/04 337/324
3,277,860 A * 10/1966 Lindberg, Jr. ..... G08B 17/04 116/216
3,390,365 A 6/1968 Lindberg, Jr.
3,748,656 A * 7/1973 Gray ..... G01M 3/2815 340/605
4,072,933 A * 2/1978 Pun ..... G08B 13/1654 337/320
RE33,028 E * 8/1989 Simpson ..... G01L 1/2281 137/487.5
4,984,637 A * 1/1991 Finnigan ..... A62C 37/40 169/19
5,136,278 A * 8/1992 Watson ..... G08B 17/04 200/81.4
5,483,826 A * 1/1996 Schultz ..... B60C 23/009 340/445
5,691,702 A * 11/1997 Hay ..... G08B 17/04 200/81.4

(Continued)

FOREIGN PATENT DOCUMENTS

EP 0364298 A2 * 4/1990 ..... G08B 17/06
FR 2396370 A1 1/1979

(Continued)

OTHER PUBLICATIONS

Omega Engineering, Strain Gauge, accessed Mar. 23, 2017.*

(Continued)

*Primary Examiner* — Emily C Terrell
(74) *Attorney, Agent, or Firm* — Locke Lord LLP; Scott D. Wofsy; Christopher J. Cillié

(57) ABSTRACT

A pneumatic sensing apparatus for use in an overheat or fire alarm system includes a sensor tube containing a pressurized gas in communication with a pressure sensor configured to sense a temperature variation based on changes of the pressurized gas. A pressure switch is coupled to the pressure sensor. The pressure switch includes a signal transducer configured to provide an output indicative of an overheat or fire alarm condition.

12 Claims, 2 Drawing Sheets

(56) References Cited

U.S. PATENT DOCUMENTS

| | | | | |
|---|---|---|---|---|
| 6,121,883 | A * | 9/2000 | Hatsir | G08B 17/04 340/449 |
| 2009/0236205 | A1* | 9/2009 | Nalla | G08B 17/04 200/81.4 |
| 2010/0156632 | A1* | 6/2010 | Hyland | G08B 25/08 340/540 |
| 2014/0177675 | A1 | 6/2014 | Rennie et al. | |
| 2014/0262723 | A1* | 9/2014 | Frasure | G08B 17/04 200/83 Y |
| 2016/0110979 | A1* | 4/2016 | Frasure | G08B 29/043 340/593 |
| 2016/0133106 | A1* | 5/2016 | Wallace | H01H 35/34 340/626 |

FOREIGN PATENT DOCUMENTS

| | | | |
|---|---|---|---|
| GB | 784713 | | 10/1957 |
| GB | 2001464 | A | 1/1979 |
| JP | 2000194967 | A | 7/2000 |
| JP | 2001134862 | A | 5/2001 |

OTHER PUBLICATIONS

Engineering Textbook, Strain Gauge, accessed Mar. 23, 2017.*
Extended European Search Report for European Patent Application No. 17155460.3, dated Jul. 6, 2017.

* cited by examiner

PNEUMATIC FIRE DETECTORS

BACKGROUND OF THE INVENTION

1. Field of the Invention

The present disclosure relates to fire detectors, and more particularly to fire detectors used to indicate an overheat or fire condition.

2. Description of Related Art

Linear pneumatic fire detectors are used in commercial aerospace to detect engine and auxiliary power generators from fire and overheat events. These detectors are also used in similar applications for land/sea vehicles and some fixed based power plants. Some of the most common fire detector types are discrete thermocouple, continuous linear thermocouple, continuous linear thermistor wire, and pneumatic gas expansion. The pneumatic gas expansion type detectors function on the principle that an inert gas within the sensor tube expands to close a contact switch and annunciate an alarm condition. When the gas cools the sensor resets.

The pressurized background gas expands in accordance to the physical gas laws. One of the ends of the pneumatic detectors is incorporated into a housing that comprises an alarm and fault integrity. When the sensor tube portion of the pneumatic detector in its final form is exposed to high temperature, the pressure inside will rise. Once the pressure reaches a predetermined threshold an alarm will initiate indicating a hazardous situation (i.e. a fire). A drawback to the current pneumatic detectors is that they only function in three discrete states; normal, alarm, or fault. The current pneumatic detectors typically have two internal pressure switches, one that reports the static no alarm (normal or fault) pressure state and a second switch that reports the alarm pressure state.

Such conventional methods and systems have generally been considered satisfactory for their intended purpose. However, there is still a need in the art for improved pneumatic fire detector with trend monitoring. The present disclosure provides a solution for this need.

SUMMARY OF THE INVENTION

A pneumatic sensing apparatus for use in an overheat or fire alarm system includes a sensor tube containing a pressurized gas in communication with a pressure sensor configured to sense a temperature variation based on changes of the pressurized gas. A pressure switch is coupled to the pressure sensor. The pressure switch includes a signal transducer configured to provide an output indicative of an overheat or fire alarm condition. The pressure switch can include an alarm switch and wherein the signal transducer is configured to detect a deflection in the alarm switch prior to a fire alarm condition. The signal transducer can include a strain gauge.

The pressure switch can further include a variable resistor in electronic communication with the alarm, signal transducer and a controller. The variable resistor is configured to measure a change in resistance wherein a change in resistance is indicative of a temperature and pressure change of the pressurized gas. The controller is in electronic communication with a memory, processor and an alarm. The memory includes instructions recorded thereon that, when read by the processor, cause the processor to compare the measured change in resistance to known acceptable ranges of the signal transducer and determine if the measured change in resistance is indicative of a normal condition or an overheat condition. The controller can activate the alarm when the measured change in resistance is indicative of an overheat condition. The controller can be configured to activate the alarm when the change in resistance is above a first pressure threshold, thereby indicating an overheat condition. The controller can be configured to activate the alarm when the change in resistance is above a second pressure threshold, thereby indicating a fire. The processor can be configured to continuously receive the change is resistance data and provide a temperature curve based on the continuously received data.

A pressure switch for indicating pressure changes in an environment includes a housing positioned between a connector and a sensor tube. The sensor tube contains a pressurized gas and a pressure sensor. An alarm switch is positioned within the housing. A variable resistor is in electronic communication with the alarm switch. A signal transducer is in electronic communication with the variable resistor. The signal transducer is configured to detect a deflection in the alarm to provide an early warning of an overheat condition.

The variable resistor can be configured to output a change of resistance based upon a change in pressure of gas within the sensor tube, wherein the change of resistance is indicative of a pending overheat or fire condition. This trending capability permits early warning of expensive engine repairs and discrimination of false alarm signatures to prevent costly aircraft diversions and unscheduled landings. The pressure switch can further include a power source in electronic communication with the fault switch and a fault switch within the housing configured to indicate if the sensor tube is damaged. The variable resistor can be in electronic communication with a controller configured to measure the change in resistance. The change in resistance of the variable resistor can be indicative of a temperature and pressure change of the pressurized gas. The controller can be configured to activate the alarm when the change in resistance is above a first pressure threshold, thereby indicating an overheat condition. The controller can be configured to activate the alarm when the change in resistance is above a second pressure threshold, thereby indicating a fire.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 3:
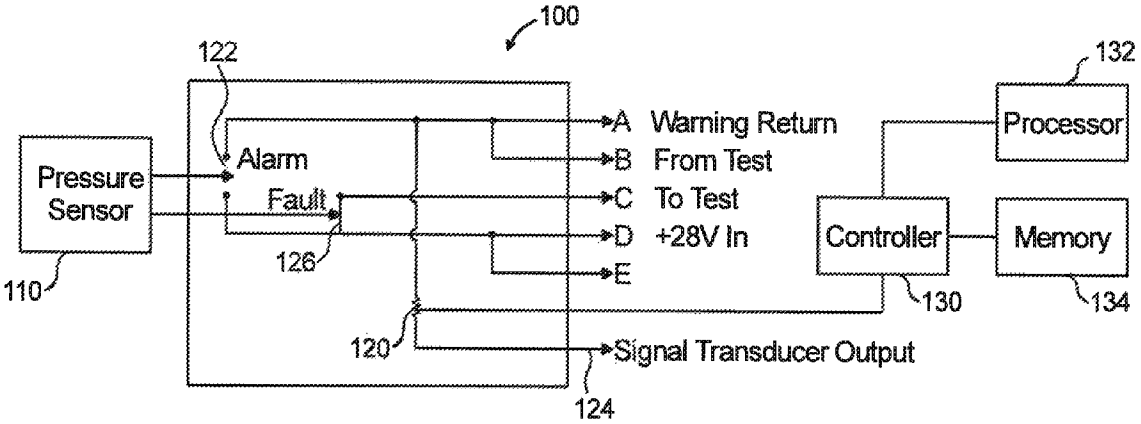
FIG. 3 is a schematic view of an exemplary embodiment of an electrical circuit for a pneumatic fire detector constructed in accordance with the present disclosure, showing a variable resistor and signal transducer.

Reference will now be made to the drawings wherein like reference numerals identify similar structural features or aspects of the subject disclosure. For purposes of explanation and illustration, and not limitation, a partial view of an exemplary embodiment of a fire detector and pressure switch in accordance with the disclosure is shown in FIG. 3 and is designated generally by reference character 100. Other embodiments of the fire detector pressure switch in accordance with the disclosure, or aspects thereof, are provided in FIG. 4, as will be described.

Figure 1:
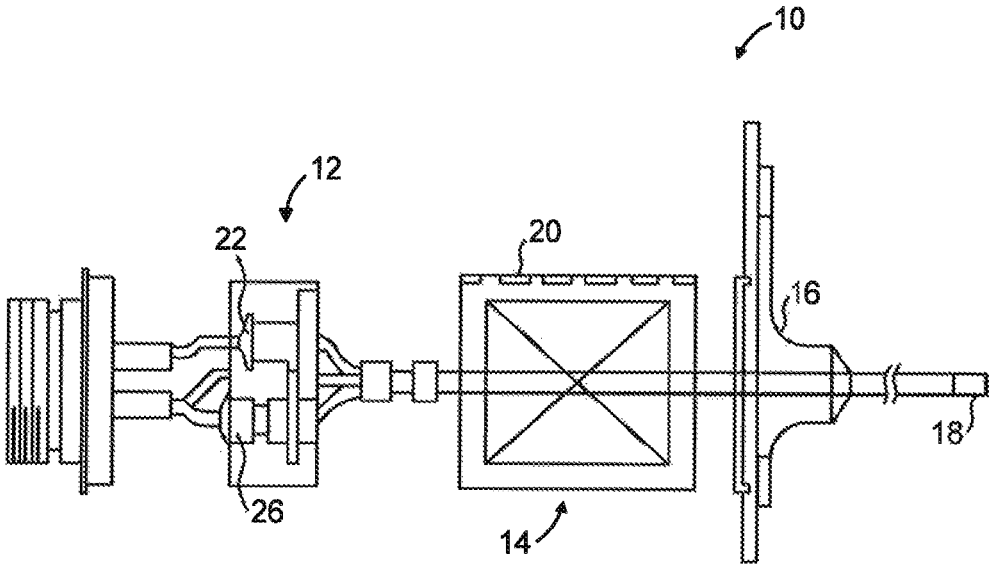
Fig. 1 (Prior Art)
FIG. 1 is a schematic view of a prior art pneumatic fire detector.
Figure 2:
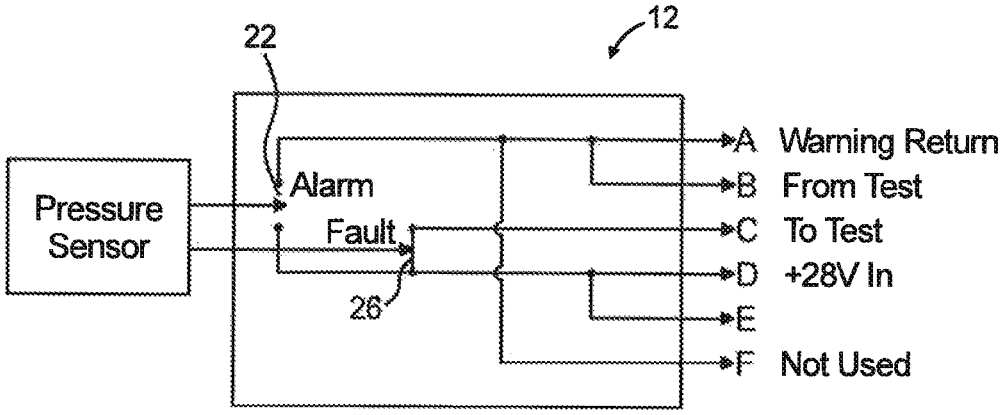
Fig. 2 (Prior Art)
FIG. 2 is a schematic view of a prior art electrical circuit for the fire detector of FIG. 1.

With reference to FIGS. 1 and 2, an example of a known type of linear pneumatic fire alarm system, is shown. The detector 10 includes a pressure switch 12 connected to a 28-volt DC voltage. A sensor tube 14 is connected to a housing cap 16 and sensor tip 18. The sensor tube 14 may be placed, for example, in the compartment of an aircraft where fire or overheat conditions are to be detected. In one example, the sensing tube 14 may be positioned in an engine compartment of an airplane. The sensor tube 14 comprises a housing 20, which stores gas, e.g., hydrogen. The pressure switch 12 further includes an alarm switch 22, and a fault switch 26. The ambient gas pressure provided in the sensor tube 14, is directly related to the average temperature within the area which the sensor tip 18 is positioned and so an increase in temperature in the region of the sensing tube 14, causes a proportionate rise in gas pressure. In a situation wherein the temperature rises above a predetermined alarm rating the normally open alarm switch 22 is closed and the alarm is activated. When cooling occurs, the gas pressure reduces, thereby opening the alarm switch 22, so that the alarm is no longer activated and it is ready to respond again. In an event the detector is damaged, for example the sensor tube is broken or cut, gas is released and the fault switch 26 which is normally closed is opened to signify failure of the system.

With reference to FIG. 3, an exemplary embodiment of the pressure switch 100 of the present disclosure is shown. The pressure switch 100 includes a variable resistor 120 and a signal transducer output 124. Both the variable resistor 120 and signal transducer output 124 provide additional means to measure and predict possible overheat situations to prevent a fire or hazardous condition. More specifically, the variable resistor 120 and signal transducer 124 provide prognostic health monitoring to the system. The variable resistor 120 is in communication with the pressure sensor 110 and provides trend monitoring data. The signal transducer 124 provides an early warning detection and can include a strain gauge, for example, either within the current pressure switch or as an addition to the pressure switch assembly. The strain gauge may not measure strain but acts as a measurement of the change in resistance.

Traditional pneumatic fire alarms only have two alarm reporting conditions. Either a no alarm condition or an alarm condition indicating an overheat/fire. Engines, particularly of an airplane, are very expensive and running them until a fire event occurs results in very costly part replacement, significant downtime and sometimes collateral damage. The signal transducer 126 of the present disclosure is configured to detect a deflection of the alarm switch 122 prior to an overheat condition. In other words, the signal transducer 126 helps to recognize the beginning stages of a possible overheat situation to prevent an actual fire. The features of the pressure switch 100 could be introduced into the current designs with a small modification to the pressure switch design and external leads to monitor the output signal.

Figure 4:
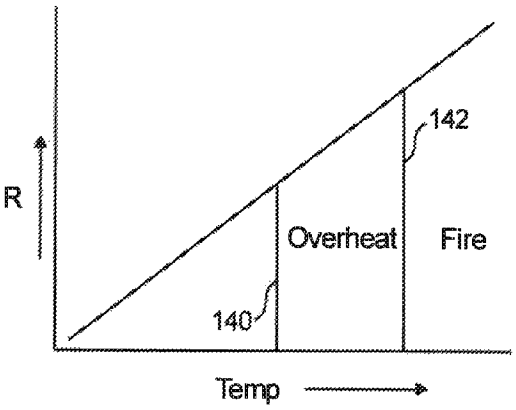
FIG. 4 is a temperature curve based on the measured change of resistance from the variable resistor of FIG. 3.

The variable resistor 120 is in electronic communication with a controller 130 and the signal transducer and is configured to measure a resistance in change that is indicative of a temperature and pressure change from the pressure sensor 110. The change in resistance can provide a temperature curve (see FIG. 4) trending information such as temperature to indicate a higher than normal engine operating condition that warrants maintenance. The controller 130 is in electronic communication with a memory 134, processor 132 and the alarm switch 132. The memory 134 includes instructions recorded thereon that, when read by the processor, cause the processor 132 to compare the measured change in resistance to known acceptable ranges of the signal transducer output 126 and determine if the measured change in resistance is indicative of a normal condition or an overheat condition. The controller 130 may also activate the alarm switch 122 when the measured change in resistance is indicative of an overheat condition. As shown in FIG. 4, the processor 132 is configured to continuously receive the change is resistance data and provide a temperature curve based on the continuously received data. A first threshold temperature 140 can be set such that the controller is configured to activate the alarm when the change in resistance is above the first pressure threshold 140, thereby indicating an overheat condition. A second threshold temperature 142 can be set such that the controller is configured to activate the alarm when the change in resistance is above the second pressure threshold 142, thereby indicating a fire. With the inclusion of both the variable resistor and signal transducer a fire condition would be avoided as an overheat condition would be detected early.

As will be appreciated by one skilled in the art, aspects of the present embodiments may be embodied as a system, method or computer program product. Accordingly, aspects of the present embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present disclosure are described above with reference to flowchart illustrations and/or block diagrams of methods, apparatus (systems) and computer program products according to embodiments of the embodiments. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in a flowchart and/or block diagram block or blocks.

The methods and systems of the present disclosure, as described above and shown in the drawings, provide for a pneumatic fire detector with superior properties including early warning of an overheat condition and trend monitoring. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A pneumatic sensing apparatus for use in an overheat or fire alarm system, comprising:

a sensor tube containing a pressurized static gas in communication with a pressure sensor in a fixed volume configured to sense a temperature variation based on changes of the pressurized static gas; and a pressure switch coupled to the pressure sensor, wherein the pressure switch includes a signal transducer configured to provide an output indicative of an overheat or fire alarm condition, wherein the pressure switch further comprises a variable resistor in electronic communication with an alarm switch, the signal transducer and a controller in communication with a processor, the variable resistor configured to measure a change in resistance, wherein a change in resistance is indicative of a temperature and pressure change of the pressurized gas, wherein the processor is configured to continuously receive the change in resistance data and provide a temperature curve based on the continuously received data and wherein a first threshold temperature is defined based on the temperature curve and a second threshold temperature is defined based on the temperature curve, wherein the second threshold temperature is higher than the first threshold temperature, wherein the controller is configured to activate the alarm when the change in resistance is above the first pressure threshold, thereby indicating an overheat condition, and wherein the controller is configured to activate the alarm when the change in resistance is above the second pressure threshold, thereby indicating a fire.

2. The apparatus of claim 1, wherein the signal transducer is configured to detect a deflection in the alarm switch prior to a fire alarm condition.

3. The apparatus of claim 2, wherein the signal transducer includes a strain gauge.

4. The apparatus of claim 1, wherein the controller is in electronic communication with a memory, processor and an alarm, wherein the memory includes instructions recorded thereon that, when read by the processor, cause the processor to:

compare the measured change in resistance to known acceptable ranges of the signal transducer;

determine if the measured change in resistance is indicative of a normal condition or an overheat condition; and activate the alarm when the measured change in resistance is indicative of an overheat condition.

5. A pressure switch for indicating pressure changes in an environment, the pressure switch comprising:

a housing positioned between a connector and a sensor tube, the sensor tube containing a pressurized static gas and a pressure sensor within a fixed volume;

an alarm switch within the housing;

a variable resistor in electronic communication with the alarm switch; and a signal transducer in electronic communication with the variable resistor, wherein the signal transducer is configured to detect a deflection in the alarm to provide an early warning of an overheat condition wherein the variable resister is further in communication with a controller in communication with a processor, the variable resistor configured to measure a change in resistance, wherein a change in resistance is indicative of a temperature and pressure change of the pressurized gas, wherein the processor is configured to continuously receive the change is resistance data and provide a temperature curve based on the continuously received data, wherein a first threshold temperature is defined based on the temperature curve and a second threshold temperature is defined based on the temperature curve, wherein the controller is configured to activate the alarm when the change in resistance is above a first pressure threshold, thereby indicating an overheat condition, and wherein the controller is configured to activate the alarm when the change in resistance is above a second pressure threshold, thereby indicating a fire.

6. The pressure switch of claim 5, wherein the variable resistor is configured to output a change of resistance based upon a change in pressure of gas within the sensor tube, wherein the change of resistance is indicative of an overheat and fire condition.

7. The pressure switch of claim 5, further comprising:

a power source in electronic communication with the alarm switch; and a fault switch within the housing configured to indicate when the sensor tube is damaged.

8. The pressure switch of claim 5, wherein the controller is configured to measure the change in resistance, wherein the change in resistance of the variable resistor is indicative of a temperature and pressure change of the pressurized gas.

9. The pressure switch of claim 1, wherein the second pressure threshold is associated with a temperature that is greater than a temperature associated with the first temperature threshold.

10. The pressure switch of claim 1, wherein the second pressure threshold is associated with a variable resistor resistance that is greater than a variable resistor resistance associated with the first pressure threshold.

11. The pressure switch of claim 5, wherein the second pressure threshold is associated with a temperature that is greater than a temperature associated with the first temperature threshold.

12. The pressure switch of claim 5, wherein the second pressure threshold is associated with a variable resistor resistance that is greater than a variable resistor resistance associated with the first pressure threshold.

* * * * *